United States Patent [19]

Yamashina

[11] 4,125,961

[45] Nov. 21, 1978

[54] DOLL WITH MOVEABLE ARMS, LEGS AND HEAD

[75] Inventor: Naoharu Yamashina, Tokyo, Japan

[73] Assignee: Popy Co., Ltd., Tokyo, Japan

[21] Appl. No.: 701,563

[22] Filed: Jul. 1, 1976

[51] Int. Cl.[2] ..... A63H 3/00; A63H 3/46

[52] U.S. Cl. ..... 46/145; 46/116; 46/161; 46/163

[58] Field of Search ..... 46/161, 22, 173, 145

[56] References Cited

U.S. PATENT DOCUMENTS

| | | | |
|---|---|---|---|
| 1,620,069 | 3/1927 | Bucherer | 46/161 |
| 2,808,681 | 10/1957 | Arenstein | 46/22 |
| 3,946,517 | 3/1976 | Goldfarb et al. | 46/22 |
| 3,961,440 | 6/1976 | Saito | 46/40 |
| 3,995,395 | 12/1976 | Rahmstorf | 46/161 |

FOREIGN PATENT DOCUMENTS

| | | | |
|---|---|---|---|
| 399,333 | 4/1909 | France | 46/161 |
| 963,231 | 12/1949 | France | 46/161 |
| 812,707 | 4/1959 | United Kingdom | 46/22 |

*Primary Examiner*—F. Barry Shay
*Attorney, Agent, or Firm*—Charles E. Pfund

[57] ABSTRACT

In a doll toy of the type wherein a head, arms and legs are rotatably connected to a hollow trunk region, a horizontal leaf spring is mounted in the trunk region to engage circular discs mounted on the tops of the legs. The bottom of the head is pivotally mounted in the trunk region and urged by a leaf spring. The upper ends of the arms are provided with rotary shafts extending into the trunk region and polygonal control plates engaged by a leaf spring are mounted on the inner ends of the rotary shafts. An arm of the doll may be made of two detachable parts with means in the inner part to project the other part as a missile. Openings in the shoulder areas are used to store weapons and means is provided in the hands for attaching a weapon.

4 Claims, 5 Drawing Figures

DOLL WITH MOVEABLE ARMS, LEGS AND HEAD

BACKGROUND OF THE INVENTION

This invention relates to a doll toy, more particularly a doll toy incorporating features of a superman, robot, and curious animal which is the hero of imaginary technological novels and caricatures and provided with movable parts.

SUMMARY OF THE INVENTION

It is an object of this invention to provide a doll toy constructed such that the arms, legs and head which are the main elements of the toy for representing specific features of the hero are rotatable freely and can be stopped at any desired positions in the range of rotation.

Another object of this invention is to provide a doll toy including a stepwise and a nonstepwise stopping mechanism capable of stopping the arms, legs and head at any positions in the ranges of their rotation.

Still another object of this invention is to provide a doll toy capable of ejecting a portion of the movable parts of the toy such as arms, legs and head by spring means.

A further object of this invention is to provide an improved doll toy capable of mounting and dismounting movable parts by one touch.

Still further object of this invention is to provide a doll toy capable of containing small instruments such as weapons in the body of the toy and mounting such instruments on the arms or legs.

According to this invention, these and further objects can be accomplished by providing a doll toy of the type wherein a head, arms and legs are rotatably connected to a hollow trunk region of the toy, characterized by comprising a leaf spring horizontally mounted in the trunk region, circular discs vertically mounted on the top of the legs which are inserted into the trunk region through openings at the lower end of the trunk region, a horizontal shaft extending through the circular discs for permitting them to rotate about the shaft, and means to urge the peripheries of the circular discs against the lower surface of the leaf spring.

There are also provided a second leaf spring horizontally mounted in the trunk region and urged against the bottom surface of the neck, a horizontal shaft extending through the bottom of the neck and a bearing for journalling the shaft thereby permitting the neck and head to tilt with respect to the trunk region.

The upper ends of the arms are inserted into the trunk region through openings on both sides of the trunk region and provided with rotary shafts. Polygonal control plates are secured to the inner ends of the rotary shafts and a leaf spring is mounted in the trunk region to engage the polygonal control plates.

Each arm comprises two members which are removably fitted together, an operating lever provided for one member on the side of the trunk region for holding and releasing the other member, and a compression spring contained in the other member for ejecting the same when the control lever is operated to release the other member.

In a modified embodiment of this invention, the trunk region comprises a chest region and a waist region which are removably coupled together.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
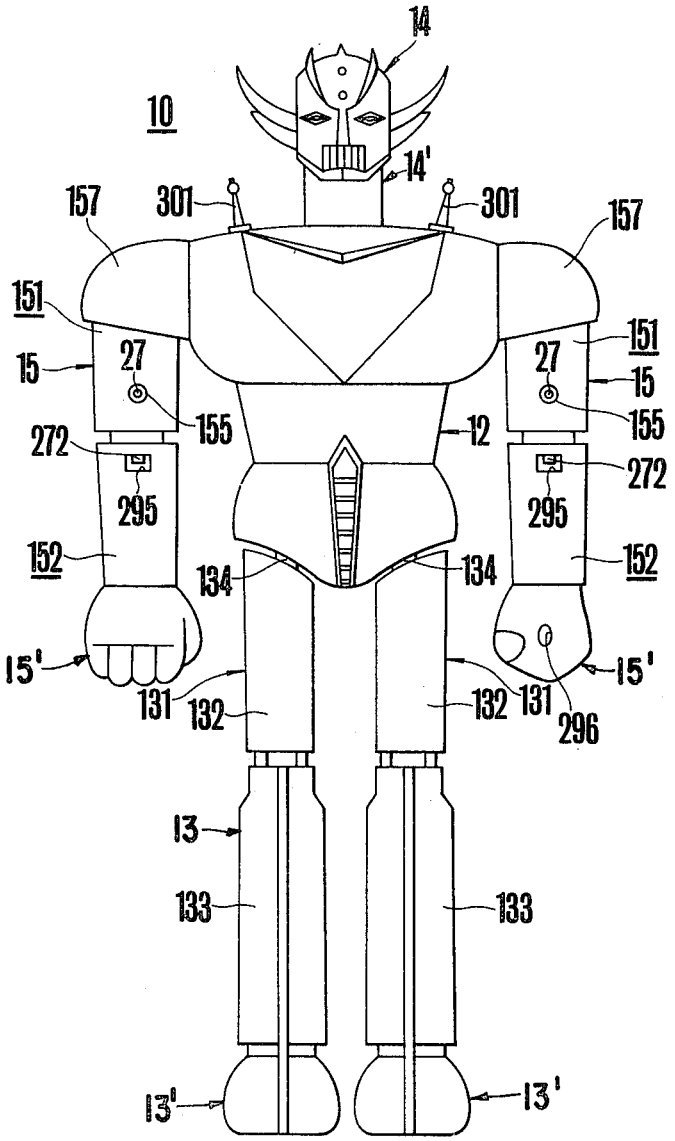
FIG. 1 is a front elevational view showing one embodiment of this invention.

FIGS. 1 to 4 show a robot toy embodying the invention. The toy generally designated by a reference numeral 10 comprises a trunk region 12, a pair of feet 13, a head 14 and a pair of arms 15 as the main elements which are made of die cast aluminum alloy or a synthetic resin at the lower ends of the legs there are feet 13' and at the lower extremities of the arms there are hands 15'. The head is provided with a neck 14'.

Figure 3:
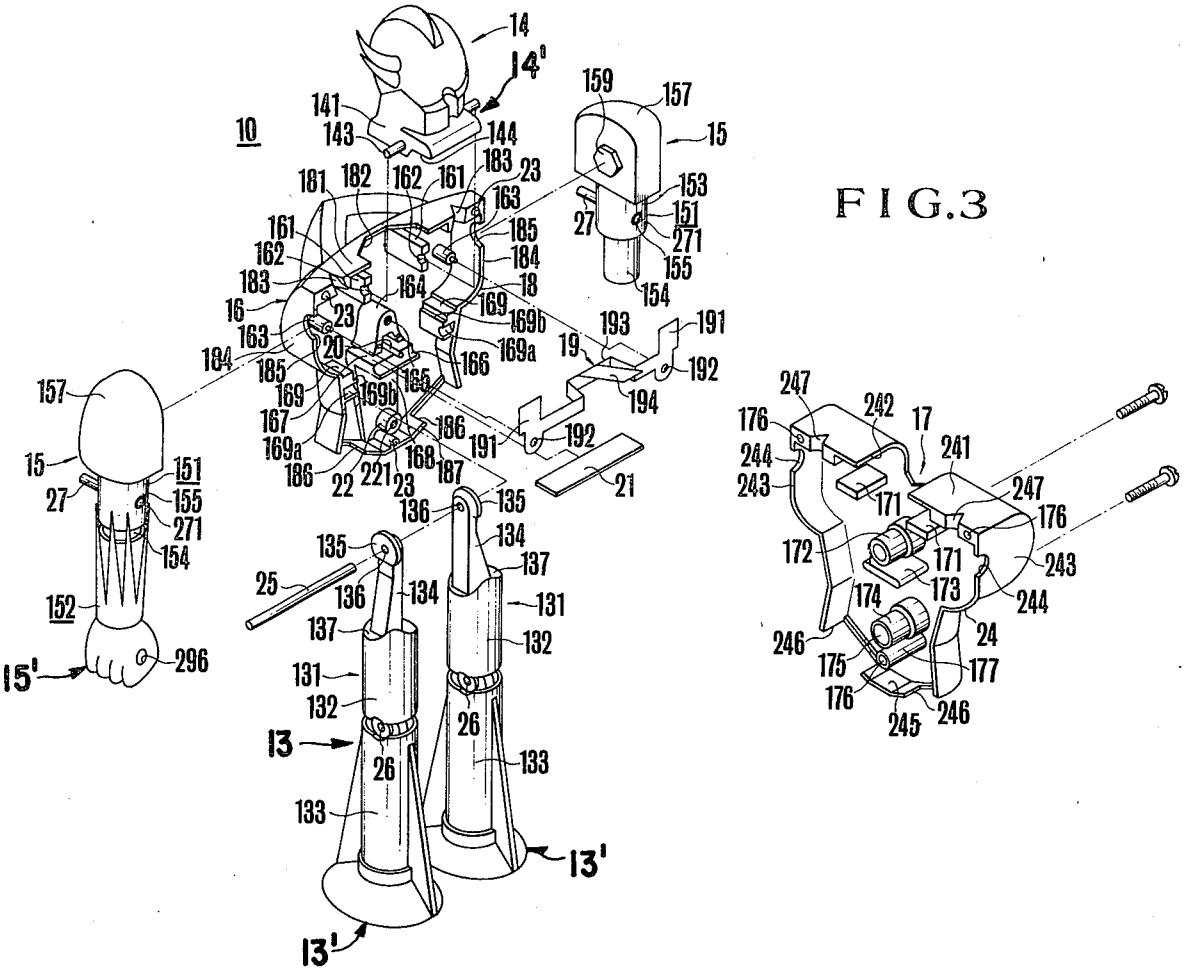
FIG. 3 is an exploded view of various component parts.

As shown by the exploded view shown in FIG. 3 the trunk region 12 is divided into a fore trunk 16 and a rear trunk 17 which are constructed to be hollow.

The fore trunk 16 is provided with a side wall 18 formed by extending a side plate to form the periphery of the fore trunk 16 on the surface confronting the rear trunk 17. The side wall 18 encircles substantially the entire periphery of the fore trunk 16 with the side edges included in the same plane. The upper surface of the side wall 18 is horizontal as at 181 and a polygonal notch 182 forming one half of an opening adapted to receive the head 14 is formed at the central portion of the horizontal portion 181. At symmetrically opposite portions with respect to notch 182 are formed inclined notches 183 having axes intersecting each other at the lower portion of the trunk region. These inclined notches 183 are adapted to receive swords or weapons of the toy as will be described later.

Vertical flat portions 184 are formed on the opposite ends of the side wall 18 near the upper end thereof to intersect at right angles with the flat surface 181, and a semicircular notch 185 is formed at the central portion of each vertical flat portion 184.

Side wall 18 is provided with notches 186 adapted to receive the upper portions of the legs at symmetrical positions and at the lower end of the fore trunk 16, the notches 186 being separated by an arcuate lower wall 187 having a definite radius of curvature. As shown in FIG. 3, each notch 186 is formed by removing a portion of a curved surface having definite radius of curvatures in the left and right directions and in the fore and aft directions parpendicular thereto and maintained at a definite spacing from the edge of a large opening near the upper end of the leg when the leg is rotated as will be described later, thus assuring a smooth rotary motion.

A plurality of integral projections are formed on the inner surface of the fore trunk 16 as will be described later. More particularly, a pair of supporting pieces 161 is projected beneath the polygonal notch 182, each provided with a semicircular notch 162 on the outer end thereof. A pair of pins 163 are symmetrically projected beneath the supporting members 161 and near the vertical flat portions 184 on the ends of the side wall 18 for supporting a leaf spring 19 by their pointed ends. The leaf spring 19 is formed by stamping a resilient metal sheet such as a steel sheet and has a symmetrical configuration. Tongues 191 are formed on the opposite ends of the leaf spring 19, and perforations 192 are formed at the lower ends of the tongues 191 for receiving the pointed ends of the pins 163. A U shaped bend 193 is formed at the central portion of the leaf spring 19 to project toward the chest portion of the fore trunk and a horizontal tongue 194 is provided for the upper edge of the U shaped bend 193 to project in the same direction as the supporting pieces 161.

A thick supporting member 164 is provided beneath pins 163 and along the axis of the fore trunk 16. The supporting member 164 is formed with a threaded opening 165 for receiving a screw adapted to unite together the fore and rear trunks 16 and 17. A bearing member 167 having an arcuate surface 166 at one edge is provided at a short distance beneath the supporting member. The bearing member 167 is provided with a land 168 continuing to the lower end wall 187. A pair of projections 169 are formed on the inner surface of the side wall 18 and on the opposite sides of the bearing member 167. Each projection is formed with a semicircular arcuate surface 169 coextensive with the arcuate surface 166. Shoulders **169*b* are provided for the side surfaces of the projections 169 above the arcuate surface 169*a*. A small diameter circular post 20 is formed on the upper surface of the bearing member 167 to project toward the arcuate surface 166. In this example, there is no gap between the post 20 and the upper surface of the bearing member 167**.

Figure 2:
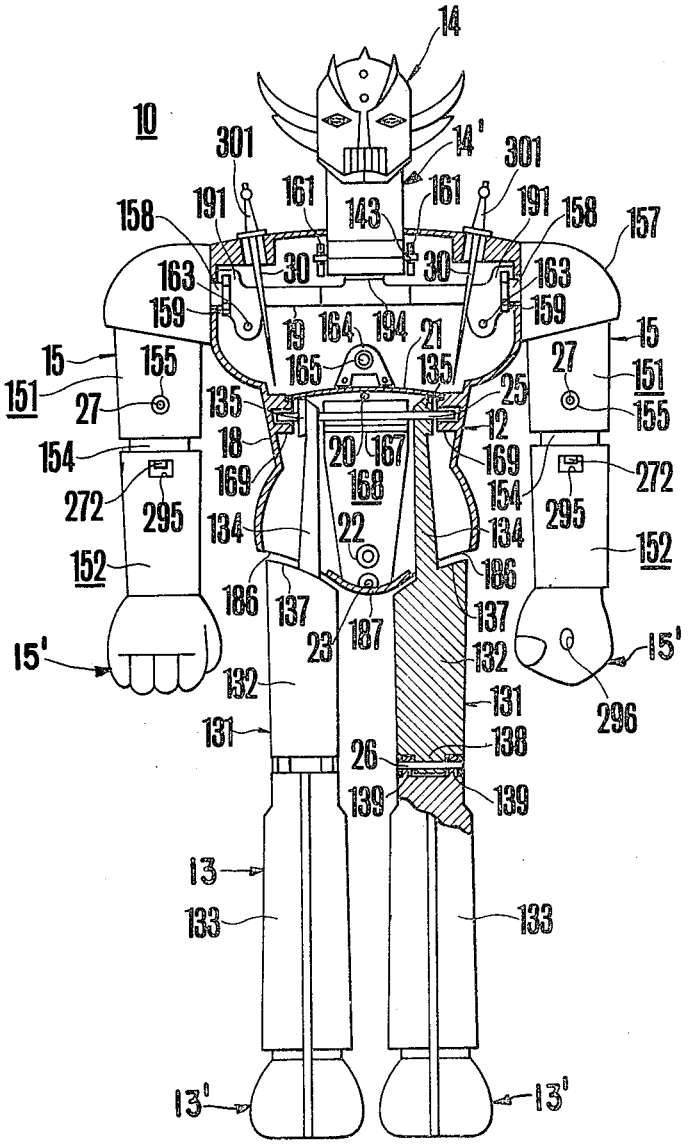
FIG. 2 is the same front elevational view showing a portion removed and in a longitudinal section.

As shown in FIG. 2, a thin transverse leaf spring 21 is mounted between the shoulders **169*b* of the projections 169 with the central portion of the leaf spring passed through a gap between the post 20 and the lower surface of the supporting member 164**.

A circular post 22 having a threaded opening 221 is projected from the lower end of the land 168 and a positioning projection 23 is provided for the inner surface of the lower end wall 187 beneath the post 22. The projection 23 may be formed at any position on the side wall 18 of the fore trunk 16, for example near the upper end of the side wall 18.

As shown in FIG. 3, the rear trunk 17 is made of the same material as the fore trunk 16 and provided with a hollow side wall 24 encircling substantially the entire periphery of the rear trunk 17.

The upper surface 241 of the side wall 24 is horizontal and provided with a notch 242, which when combined with the notch 182 of the fore trunk 16 forms a recess for receiving the neck. As can be noted from FIG. 3 the notch 242 is extending to the rear side of the rear trunk 17 thus enabling a large rearward tilting motion of the neck and head as will be described later in detail.

Vertical flat surfaces 243 are formed on both sides of the side wall 24 near the upper end thereof and the side edges of the flat surfaces are respectively formed with semicircular notches 244 which when combined with the notches of the front trunk 16 form recesses to receive rotary shafts of the arms 15.

On the lower ends of the side walls 24 are formed notches 246 which are separated by the lower end wall 245. When combined with the notches 186 at the lower end of the fore trunk 16 the notches 246 form recesses for permitting free rotation of the legs as will be described later. On both sides of the notch 242 are formed recesses 247 for receiving the swords.

A plurality of projecting members are formed on the inner surface of the side walls 24 to project into the space in the rear trunk in the order to be described hereunder.

Immediately beneath the upper horizontal surface 241 of the side wall 18 are formed a pair of projecting supporting pieces 171 at positions to close the front surfaces of the circular notches 162 of the supporting pieces 161 of the fore trunk 16 when it is joined to the rear trunk 17. A cylinder 172 is projected beneath the supporting pieces coaxially with the threaded opening 165 of the supporting member 164 of the fore trunk 16. The central bore of cylinder 172 is extending to the rear side of the rear trunk 17. A projection 173 is provided beneath the cylinder 172 to confront the bearing member 167 of the fore trunk 16 and adapted to support the rotary shafts of the feet which are received in the arcuate portions of the bearing member 167.

A cylinder 174 is projected beneath the projection 173 in coaxial with the axis of the threaded opening 221 of post 22. The central bore of the cylinder 174 is extending to the rear side of the rear trunk 17. A circular post 177 provided with an opening 176 for receiving the positioning projection 23 at the lower end of the fore trunk 16 is formed beneath the cylinder 174. A similar opening 176 is also formed on the upper portion of the rear trunk at a position facing the positioning projection 23 on the upper end of the fore trunk 16.

The legs 13 are made of the same material as the trunk and are constructed to be bendable. Each leg 13 comprises upper and lower sections 132 and 133. A thin connecting lever 134 is secured to the upper end of the uppper section 132, and a circular disc 135 is formed on the upper end of the connecting lever 134. The circular disc 135 is provided with a perforation 136 for receiving a rotary shaft 25.

As shown in FIG. 2, the rotary shaft 25 is horizontally supported by the arcuate portion 166 of the bearing member 167 of the fore trunk 167 and the arcuate portion **169*a* of the projection 169 and is firmly held by the projecting piece of the rear trunk 17. The circular discs 135 are strongly urged against the leaf spring 21 so that the discs are held positively in position unless they are subjected to a large moment of rotation, thereby holding the feet 131 at any position in the opening formed by recesses 186 and 246**.

The upper surface of each upper section 132 which supports the base portion of the connecting lever 134 is formed as a curved surface 137 having the same radius of curvature as the lower end walls 187 and 245 of the fore and rear trunks 16 and 17 so that the distance between the curved surface 137 and the lower end walls 187 and 245 is maintained constant irrespective of the angular position of the feet 131 thus permitting free rotary movement thereof.

As shown in FIG. 2, a projection 138 is formed on the lower end of each upper section 131 which is received between a pair of projections 139 on the upper end of each lower section and pivotally connected to these projections 139 by means of a pin 26. As a consequence, the leg sections 131 and 133 can rotate freely relative to each other about pin 26 and the degree of rotation is determined by the distance between the lower end of the upper section 132 and the upper end of the lower section 133.

The head 14 is formed to simulate a specific feature. The opposite sides of the neck 14' are flat and a rotary shaft 143 is secured to the lower portion of the neck. The neck 14' is fitted in a recess defined by the notches 182 and 242 on the upper ends of the fore and rear trunks 16 and 17 with the rotary shaft 143 received in the arcuate notches 162 of the supporting pieces of the fore trunk 161. As shown in FIG. 2, the lower end of the neck 14' is urged against the tongue 194 of the leaf spring 19. The side surface of the rotary shaft 143 is engaged by the projection 171 of the rear trunk 17 so that the neck can rotate freely without dropping. A shoulder 144 is formed on the lower surface of the neck 142 and the tongue 194 of the leaf spring 19 is arranged to engage the lower surface of the neck 142 as well as the shoulder 144 as the head 14 is rotated so that the head can be maintained at a upright position or a rearwardly inclined position.

Figure 4:
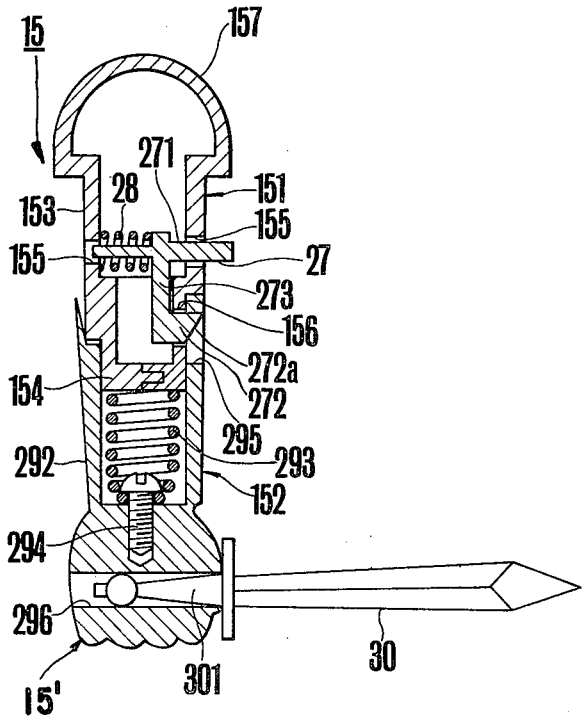
FIG. 4 is a longitudinal sectional view of an arm.

As shown in FIG. 4, each arm 15 comprises an upper arm region 151 and a lower arm region 152. The upper arm region 151 is hollow and includes a large diameter portion 153 and a small diameter portion 154, the former containing an operating lever 27. The operating lever 27 has a criss-cross shape with its horizontal portion slidably received in opposed perforations 155 formed through the side wall of the large diameter portion 153. The vertical portion 273 extends in parallel with the axis of the large diameter portion 153 and its lower end is bent at right angles to form a hook 272 which is received in a lateral opening 156 of the small diameter portion 154. A portion of the hook 272 extends to the outside of the opening 156.

A spring 28 is provided between the operating lever 27 and the inner surface of the large diameter portion 153 to surround one side of the horizontal portion 271 to urge the operating lever 27 to cause the other end of its horizontal portion to project to the outside of the perforation 155.

As shown in FIG. 2, a rotary shaft 158 is provided for the inner side surface of a shoulder 157 forming the upper end of each arm 15 and a polygonal control plate 159 is mounted on the end of the rotary shaft 158. In the example shown, the control plate 159 is hexagonal but it may be any polygon depending upon the one pitch angle of the click motion provided by the control plate. The rotary shaft 158 is received in the opening defined by the notches 185 and 244 of the fore and rear trunks and the control plate 159 is urged against the tongues 191 on the opposite ends of the leaf spring 19. Consequently when the upper arm region 151 is rotated it is stopped when one side of the polygonal control plate 195 comes in parallel with the tongue of the leaf spring 19 thus providing a click motion having stages of the number equal to the number of sides of the control plate. Thus the arm 15 is stopped at a desired position by the force of the leaf spring 19.

Although in the foregoing description the upper arm section is constructed to provide a click motion, it is possible to provide a stepless control by increasing the stiffness of the leaf spring 19 and by forming the control plate 159 to have a circular shape.

The lower arm region 152 is also made to be hollow except the hand 15' and a coil spring 293 is contained in the hollow cylindrical portion 292, the lower end of the spring being anchored by a screw 294. A plurality of circular notches 295 are formed near the upper end of the hollow portion 292 when these notches 295 are aligned with the hook 272 projecting through the opening 156 of the small diameter portion 154 of the upper arm region 151 and when the lower arm region 152 is fitted over the small diameter portion 154 of the upper arm region 151 the upper end of the lower arm region 152 will urge the operating lever 27 to the left as viewed in FIG. 4 against the force of spring 28 by engaging the inclined surface **272*a* unti the hook 272 fits in the notch 295 thus locking the lower arm region 152 by hook 272. At this time, the coil spring 293 in the lower arm region 152 stores energy. Accordingly, by pressing the operating lever 27 against the force of spring 28 the hook 272 is also pressed to release the lower arm region 152 whereby the lower arm region and hand are quickly projected by the force of the coil spring 293**.

This mechanism of ejection the arm can also be applied to the head and feet, if desired.

The hand 15' at the lower arm region 152 is provided with a perforation 296 to receive the handle 301 of the sword 30. The sword 30 may be removably inserted into the space within the trunk region 12 through an opening defined by the notches 183 and 247 at the upper ends of the fore and rear trunks 16 and 17 as shown in FIG. 2.

Since the toy of this embodiment is constructed as above described, the legs 13, head 14 and arms 15 can be moved to any position within a prescribed range stepwisely or without any step so that the toy can assume any desired attitude. Moreover, it is also possible to eject the lower arm regions and to mount weapons thereon. Further, leaf springs are used as the stopping mechanisms for controlling the rotary movements of the feet, head and arms so that the stopping mechanisms are effective over a long period until the leaf springs lose their resiliency.

In addition to the lower arm regions it is also possible to eject fingers or nails.

Figure 5:
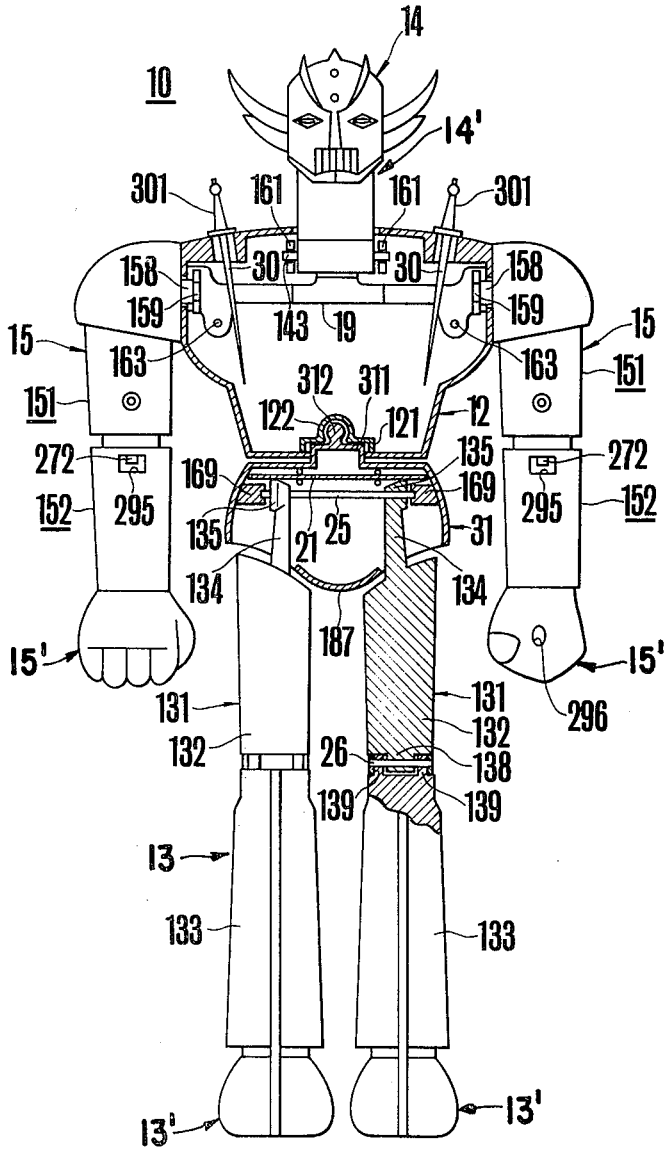
FIG. 5 is a front view, partly in section of a modified embodiment of this invention.

FIG. 5 shows a modified embodiment of this invention wherein the trunk region 12 and the legs 13 are removably connected to a waist region 31.

More particularly, the waist region 31 is constructed as an independent unit from the trunk region 12 and legs 13, and the legs 13 are connected to the waist region 31 by a mechanism identical to that described above. Thus, a connecting post 134 is rotatably connected through a circular disc 135 to rotary shaft 25 rotatably journalled by a projection 169 on the inner side surface of the waist region 31 and the disc 135 is urged against leaf spring 21 suitably secured to the wast region 31.

A projection 311 is provided for the upper end of the waist region 31 and a spherical projection 312 is formed on the upper end of projection 311. The spherical projection is removably received in a resilient semispherical adaptor 122 having a narrow inlet opening and provided to cover an upright protrusion at the center of the trunk region 12. Accordingly the legs 13 can be connected and disconnected to and from the trunk region 12 through the waist region 31.

When it is difficult to integrally mould the protrusion 121, adaptor 122 and the trunk region 12, a commercial snap hook may be used.

As above described according to this invention, it is possible to rotate, stepwisely or non-stepwisely, the feet, head and arms of a doll toy incorporating various features with respect to the trunk region of the toy and to positively hold the legs, head and arms at any adjusted positions so that the toy can assume various attitudes. Furthermore, resilient means is used to eject the lower arm regions and to connect and disconnect the legs to and from the trunk region to improve the commercial value of the toy. Moreover, as various portions of the toy are made of die cast light alloys or moulded resin, it is easy to manufacture them, can reduce the manufacturing cost and prolong the life of the toy.

While the invention has been shown and described in terms of some specific embodiments, it should be understood that many changes and modifications would be obvious to one skilled in the art without departing from the scope of the invention as defined in the appended claims.

What is claimed is:

1. A doll comprising a trunk defining shoulders, a waist and hips, members simulating a head, neck, arms, legs and feet, said trunk containing at the top an opening for pivotally receiving the neck member, at the opposite sides openings for pivotally receiving the arm members and at the bottom openings for pivotally receiving the leg members, means for pivotally connecting the neck, arms and legs to the interior of the trunk for pivotal movement of said members exclusively about axes transverse to the trunk, said opening at the top being of sufficient size to permit the neck to be rocked forwardly and rearwardly therein and said openings at the bottom being of sufficient size to permit the legs to be moved forwardly and rearwardly, said pivot means for the neck comprising pins fixed to the neck at opposite sides and transversely spaced bearing elements below and at opposite sides of the top opening for rotatably receiving said pins, said pivot means for the arms comprising shafts fixed to the arms rotatably journaled in the openings in the sides of the trunk and said pivot means for the legs comprising a shaft fixed within the trunk in the region of the hips transversely thereof and hangers fixed at the upper ends of the legs which extend through the bottom openings into the trunk in the region of the hips containing holes for rotatably receiving the shaft and means for frictionally controlling pivotal movement of the head and neck, arms, and legs comprising, for the head and neck and the arms, compound leaf spring means disposed transversely of the trunk in the region of the shoulders comprising a cantilever-supported tongue at the center which extends forwardly and upwardly into engagement with the lower end of the neck forwardly of its pivot axis and two vertical cantilever-supported tongues, one at each end of the compound leaf spring means which bear against the arm shafts, and a simple leaf spring means for the legs fixed within the trunk in the region of the hips above the shaft supporting the leg hangers with its ends yieldably pressed against the upper ends of the leg hangers, and wherein the inner ends of the arm shafts and the upper ends of the leg hangers are provided with disk means of larger diameter than the respective shafts with which the spring means frictionally engage sufficiently to restrain free pivotal movement of the arms and legs relative to the trunk.

2. A doll toy according to claim 1 wherein said trunk contains at the top in the region of the shoulders at least one opening for accommodation of a weapon, and wherein there are hands at the lower extremities of the arms, at least one of which contains an opening for mounting of a weapon.

3. A doll toy according to claim 1 wherein the trunk is divided at the waist into upper and lower portions, the upper portions mounting the head and arms and the lower portion mounting the legs and there are interengageable coupling means removably coupling the upper and lower portions of the trunk to each other.

4. The doll toy according to claim 1 wherein at least one of the arms comprises two members which are removably fitted together, an operating lever provided on one of said two members for holding and releasing the other of said two members, and a compression spring contained in said other member for ejecting the same when said control lever is operated to release the other member.

* * * * *